United States Patent [19]

Pryor et al.

[11] 4,244,203

[45] Jan. 13, 1981

[54] COOPERATIVE ROLLING PROCESS AND APPARATUS

[75] Inventors: Michael J. Pryor, Woodbridge; Joseph Winter, New Haven, both of Conn.

[73] Assignee: Olin Corporation, New Haven, Conn.

[21] Appl. No.: 25,232

[22] Filed: Mar. 29, 1979

[51] Int. Cl.[3] ..... B21B 1/22; B21B 39/08

[52] U.S. Cl. ..... 72/205; 72/366

[58] Field of Search ..... 72/205, 199, 366, 234

[56] References Cited

U.S. PATENT DOCUMENTS

| | | | |
|---|---|---|---|
| 2,291,361 | 7/1942 | Walsh | 72/205 X |
| 2,316,067 | 4/1943 | Hickman | 72/205 X |
| 2,332,796 | 10/1943 | Hume | 72/205 |
| 2,370,895 | 3/1945 | Wean | 72/205 X |
| 2,392,323 | 1/1946 | Koss | 72/205 X |
| 2,526,296 | 10/1950 | Stone | 72/205 |
| 3,238,756 | 3/1966 | Coffin, Jr. | 72/205 |
| 3,253,445 | 5/1966 | Franek | 72/205 |
| 3,332,292 | 7/1967 | Roberts | 72/234 X |
| 3,377,830 | 4/1968 | Campbell | 72/205 |
| 3,394,574 | 7/1968 | Franek et al. | 72/205 |
| 3,527,078 | 9/1970 | Lawson et al. | 72/205 |
| 3,798,950 | 3/1974 | Franek et al. | 72/205 |
| 3,823,593 | 7/1974 | Vydrin et al. | 72/205 |
| 3,861,188 | 1/1975 | Kamit et al. | 72/234 |
| 3,871,221 | 3/1975 | Vydrin et al. | 72/205 |
| 3,911,713 | 10/1975 | Vydrin et al. | 72/205 |

FOREIGN PATENT DOCUMENTS

| | | |
|---|---|---|
| 443780 | 8/1970 | Australia . |
| 46551 | 3/1974 | Australia . |
| 691139 | 12/1965 | Belgium . |
| 363259 | 11/1922 | Fed. Rep. of Germany . |
| 1506671 | 11/1967 | France . |
| 1506680 | 11/1967 | France . |
| 2371246 | 11/1976 | France . |
| 54-5848 | 3/1979 | Japan . |
| 54-10258 | 3/1979 | Japan . |
| 1002936 | 9/1965 | United Kingdom . |
| 1086643 | 10/1967 | United Kingdom . |
| 1087097 | 10/1967 | United Kingdom . |
| 1117585 | 6/1968 | United Kingdom . |
| 1125554 | 8/1968 | United Kingdom . |
| 1219967 | 1/1971 | United Kingdom . |
| 1223188 | 2/1971 | United Kingdom . |
| 2004486 | 4/1979 | United Kingdom . |

OTHER PUBLICATIONS

"Status of Contact-Bent Stretch Rolling", Coffin, Jr., Journal of Metals, Aug., 1967, pp. 16–22.

"Introduction to the Theory of Plasticity for Engrs.", Hoffman & Sachs, McGraw-Hill, 1953, pp. 214–239.

"New Sheet Rolling Process from Russia", Machinery & Production Engrg., vol. 128, No. 3319, Jul. 21, 1976, Burgess Hill, Sussex, Great Brit.

"Shear Rolling . . . ", Hollmann et al., Stahl and Eisen, vol. 99, No. 6, Mar. 26, 1979, Dusseldorf, Ger.

*Primary Examiner*—Milton S. Mehr

*Attorney, Agent, or Firm*—Paul Weinstein

[57] ABSTRACT

An apparatus and process for rolling metal strip to provide increased percentage reductions in the thickness of the strip per pass and increased total reduction between anneals. A 4-high rolling mill is modified so that it is back-up roll driven such that the back-up rolls have different peripheral speeds in the same ratio as the desired strip reduction. The strip travels through the mill in a serpentine arrangement to provide three reductions per pass. Forward and back tension are applied to the strip during rolling.

31 Claims, 6 Drawing Figures

COOPERATIVE ROLLING PROCESS AND APPARATUS

BACKGROUND OF THE INVENTION

This invention relates to a method and apparatus for reducing the thickness of metal strip. The invention is applicable to a wide range of metals and alloys which are capable of plastic deformation. The apparatus comprises a cooperative rolling mill which is adapted to provide increased reduction in thickness of the metal strip per pass as well as increased total reduction between anneals as compared to various prior art approaches.

PRIOR ART STATEMENT

Conventionally rolling mills are found with many different configurations, including two high, four high, and cluster mills. With these conventional mills the total reduction which can be achieved in the metal strip before annealing is required, is determined by the roll separating force generated during the rolling operation. This separating force increases from pass to pass as the metal strip becomes work hardened until a maximum limit is reached for the mill. When the separating force reaches a sufficiently high level roll flattening, mill elasticity and strip flow strength are in balance and in the mill ceases to make any significant further reductions in the strip thickness. Normally, prior to the strip reaching such a separating force level, further rolling is uneconomic and the strip is annealed to make it softer and thereby reduce the separating force in the next pass through the mill.

It is desired that the present reduction in thickness per pass and the total reduction which can be taken in the strip by a rolling mill between anneals be as large as possible so as to reduce the need for costly and time consuming anneals. Various approaches have been described in the prior art for achieving such increases in available reduction in thickness between anneals. In most of these techniques, a stretching component has been added to the rolling reduction in order to provide increased percentages of reduction.

One such approach comprises contact bend stretch rolling, also known as C-B-S rolling. This technique is illustrated in U.S. Pat. No. 3,238,756 to Coffin, Jr., and in an article by Coffin, Jr., in *The Journal of Metals,* August, 1967, pages 14–22. In the CBS rolling process plastic bending is provided in conjunction with longitudinal tension and rolling pressure to provide strip or foil thickness reductions. In addition, the rolling mill utilizes a speed ratio between the contact rolls as a means for determining and controlling reduction in place of a conventional rigid roll gap. The strip enters the mill and is threaded around a large roll called the entry contact roll. The strip is then wound about a small floating roll called the bend roll. The bend roll is cradled in the gap between the first large roll and a second large roll, called the exit contact roll. The strip is maintained under tension to prevent slipping between the strip and the two contact rolls. The contact rolls are driven at a fixed ratio of surface speed with respect to one another. Reduction occurs at two bite points between the bend roller and the two contact rolls. The reduction is the consequence of the drawing or the stretching of the strip around the small bend roll and the forcing of the strip up into the gap between the two contact rolls where it is squeezed, bent and rolled sufficiently at both reduction points, to match the speed ratio. This apparatus is more fully described in the aforenoted article and patent by Coffin, Jr. The CBS process is subject to a number of difficulties, as are well-known in the art. In particular, it is difficult to lubricate the bend roll and because of its very small diameter it rotates at high speeds and tends to heat up and distort. This can cause irregularities in the resultant strip.

Yet another prior art approach comprises a process of rolling metal sheet commonly referred to as "PV" rolling. This process is amply described in U.S. Pat. Nos. 3,709,017 and 3,823,593 both to Vydrin et al. In this process the sheet is rolled between driven rolls of a rolling mill, wherein each adjacent roll is rotated in an opposite direction to a next adjacent roll and at a different peripheral speed with respect thereto. The process is effected with a ratio between the peripheral speeds of the rolls controlling the reduction of the strip being rolled. The rate of travel of the delivery end of the strip is equal to the peripheral speed of the driving roll that is rotated at a greater speed. Tension is applied to at least the leading portion of the strip and the application of back tension is also described. The strip may be wrapped in a manner so as to encompass the rolls through an arc of 180° or more.

PV rolling is normally carried out using relatively large diameter rolls of equal diameter. This is so because of the high torque required to drive the rolls. However, by employing large diameter rolls, it is difficult to get a large bite and, therefore, a large reduction in strip thickness per pass. Further, the maximum total reduction achievable with a PV rolling mill between anneals is governed by roll flattening. Roll flattening is a more serious problem with large work rolls than with small work rolls. U.S. Pat. Nos. 3,811,307, 3,871,221 and 3,911,713 all to Vydrin et al. are illustrative of various modifications and improvements which have been made to the PV rolling mill and process.

Many other techniques have been suggested for rolling in a non-conventional manner wherein there is stretching of the strip. Illustrative of such processes and apparatuses are U.S. Pat. Nos. 2,332,796 to Hume, 2,526,296 to Stone, 3,253,445 to Franek and 3,527,078 to Lawson et al.

One particularly interesting approach is described in U.S. Pat. No. 3,339,475 to Franek et al. In this patent there is described an apparatus and process for rolling strip metal wherein the rolling mill includes first and second back-up rolls arranged in spaced relation for rotation about fixed axes. The back-up rolls are positively driven so that the second has a peripheral speed greater than the first. Disposed between the back up rolls are first and second freely rotatable work rollers each of which has a diameter small as compared with that of the back-up rolls. The work rolls are moveable bodily relative to the back-up rolls and cooperate one with the other and one with each of the back-up rolls. A stabilizing roller is used to apply pressure to one of the work rollers, relative to a back-up roll.

In Franek et al. the strip is moved lengthwise under tension through a path defined by encompassing the strip about the first back-up roll and then in an "S" shape about the work rolls and then encompassing the strip about the second back-up roll. The work rolls are arranged so that a tension load applied to the strip provides the sole means for producing the rolling load at each of the three nips defined by the respective rolls. In the Franek et al. process and apparatus the rolling load is produced solely by the lengthwise tension in the strip.

Approaches such as C-B-S rolling and the one described in the Franek et al. patent suffer from several drawbacks in addition to those already described above. Since the strip tension is the active element in creating the force between the rolls at each roll nip it must be relatively high. It is difficult to roll soft strip which would be subject to breaking or other shape problems such as waviness because of the high degree of tension force required. The use of high amounts of tension as would be required by Franek et al. could create internal defects in the strip and any strip with edge cracking tendencies or which would be notch brittle would be difficult to roll. Further the apparatus is complicated by the necessity of a stabilizing means such as a stabilizing roll.

These difficulties which arise from the necessity of using high amounts of tension in the process are also shared by many of the other non-conventional rolling techniques described above. It has been found desirable to provide a rolling mill which can process metal strip with high percentages of reduction in thickness between anneals without the deficiencies of the prior art. In order to achieve large bits in the nip of the rolls, it is desired to utilize small diameter rolls. However, the diameter and arrangement of the rolls should not be so small as to make it difficult to lubricate and cool the mill. Further it is desired in accordance with this invention to provide a mill which is less complicated than most of those described above.

SUMMARY OF THE INVENTION

In accordance with this invention a process and apparatus is provided for rolling metal strip by non-symmetrical plastic flow. Unusually high rolling reductions per pass and total rolling reductions between anneals can be achieved within the confines of a modified four high rolling mill. The approach in accordance with this invention makes maximum utilization of the deformation ability of metallic strip by optimization of roll compression and stretch elongation to derive maximum ductility.

The unusual results in accordance with this invention can be obtained by modifying a standard four high rolling mill, although various other configurations are possible as will be described hereinafter. The modification of the rolling mill involves primarily changing the drive mechanism in order to assure that the mill is driven by the back-up rolls and to provide some means by which the back-up rolls can be driven at different speeds. The mill is then strung up or threaded so that the incoming strip is wrapped around the slower moving driven back-up roll and then forms an "S" shape bridle around free wheeling work rolls. Finally it exits the mill by encompassing the fast moving driven back-up roll.

When this is done and the mill is powered and put under appropriate pressure by a screw down mechanism, three reductions are obtained. The first reduction point is between the first driven slow roll and its adjacent first free wheeling work roll. The second reduction is taken between the two work rolls and the third reduction which is similar to the first reduction is taken between the second work roll and the second back-up roll This cooperative rolling approach results in three rolling passes being accomplished in one throughput of the strip.

The mechanisms which govern the reduction at each of the bites, tend towards reducing the separating force required for rolling. Forward and back tension for the process is provided by wrapping the metal strip around the driven backup rolls, in such a way so as to provide shear drag on the workpiece. The strip is also tensioned as it enters and leaves the mill by conventional means.

Accordingly, it is an object of this invention to provide an improved process and apparatus for rolling metal strip.

It is a further object of this invention to provide a process and apparatus as above which is capable of providing non-symmetrical plastic flow.

It is a further object of this invention to provide a process and apparatus as above providing increased rolling reductions per pass and total rolling reductions between anneals.

These and other objects will become more apparent from the following description and drawings.

DETAILED DESCRIPTION OF PREFERRED EMBODIMENTS

In accordance with this invention a cooperative rolling process and apparatus is provided. The cooperative rolling system optimizes bi-axial forces to maximize rolling reduction through a process of non-symmetrical plastic flow. It is applicable to any desired metal or alloy which can be plastically deformed. It is particularly adapted for processing metal strip. Unusually high rolling reductions per pass and total rolling reductions between anneals can be achieved through the use of a four high rolling mill modified in accordance with this invention. The approach of this invention makes maximum utilization of the deformation ability of the metallic strip by optimization of roll compression and stretch elongation to derive maximum ductility.

The modification of the rolling mill involves primarily changing the drive mechanism so that the mill is back-up roll driven and the provision of some means for driving the back-up rolls at respectively different speeds one from the other.

Figure 1:
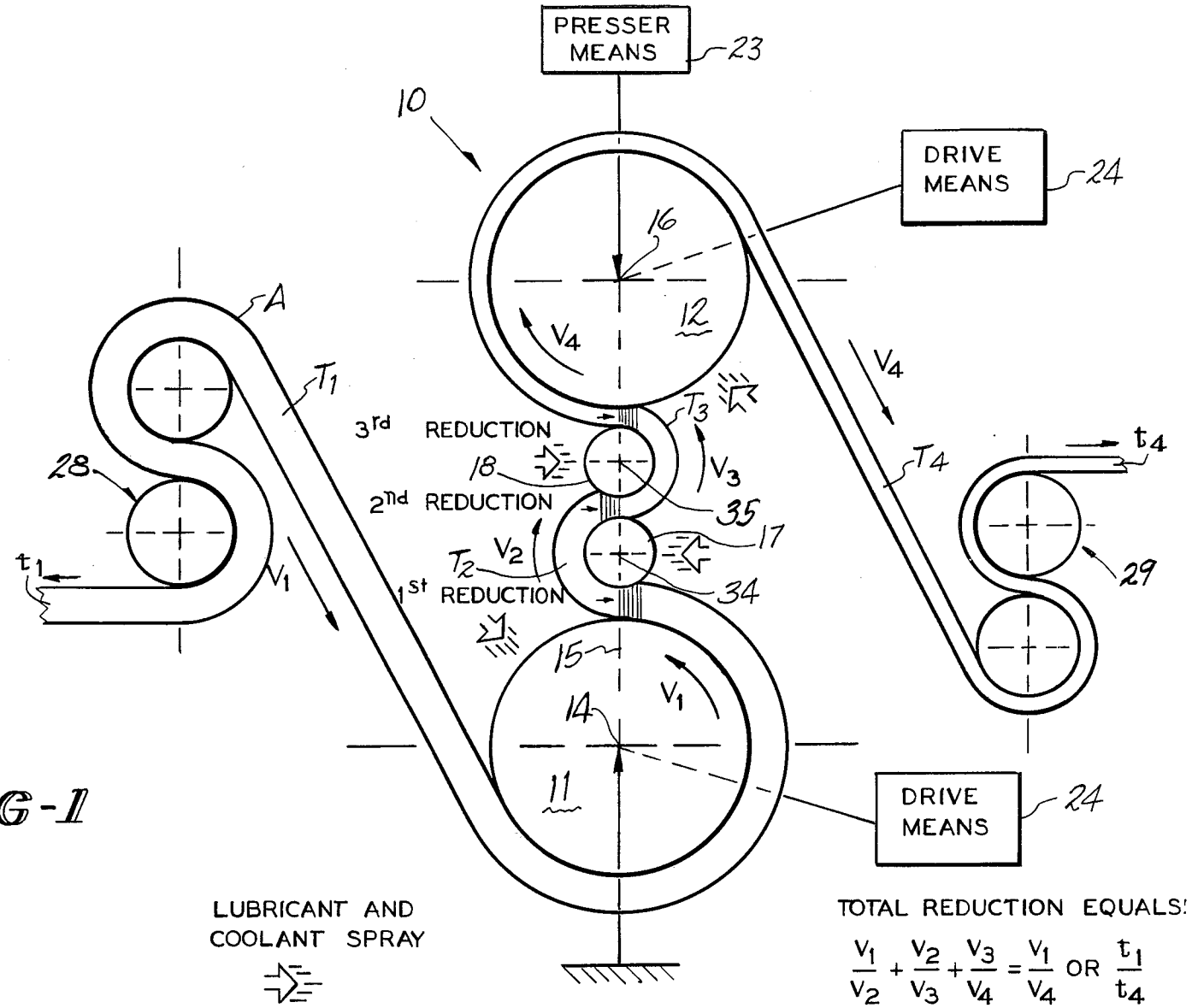
FIG. 1 is a schematic illustration of a side view of an apparatus in accordance with one embodiment of this invention.
Figure 3:
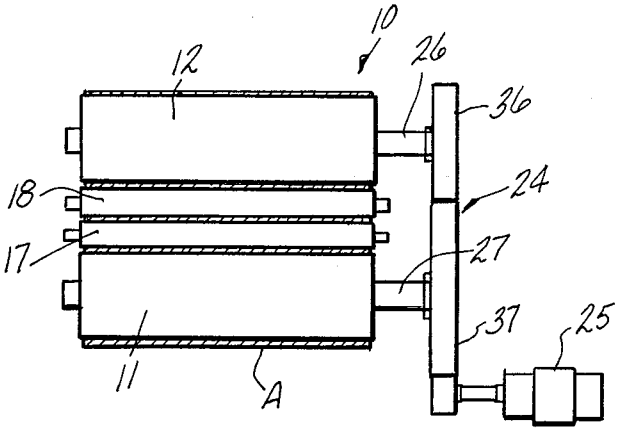
FIG. 3 is a partial view showing the drives to the rolls of the apparatus of FIG. 1.
Figure 2:
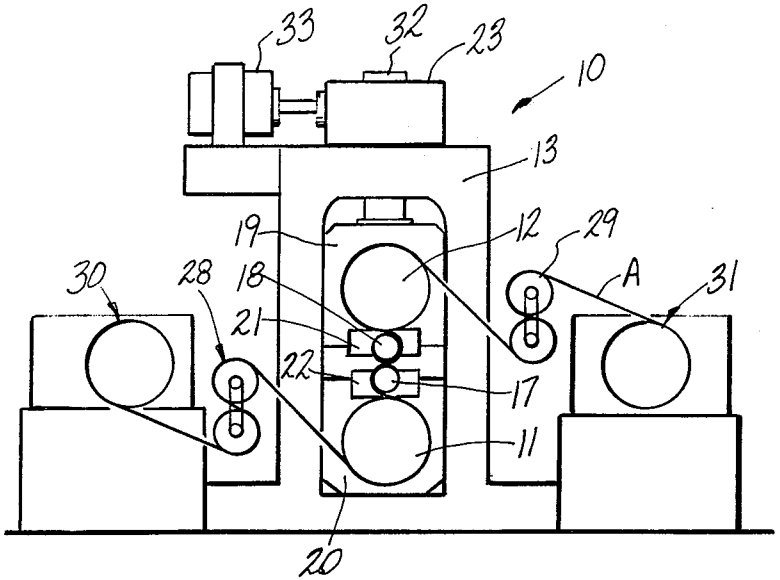
FIG. 2 is a more detailed illustration of the apparatus of FIG. 1.

Referring now to FIGS. 1–3, there is shown by way of example a cooperative rolling mill 10 in accordance with a preferred embodiment of the present invention. The cooperative rolling mill 10 comprises first 11 and second 12 back-up rolls of relatively large diameter. The lower back-up roll 11 is journaled for rotation in the machine frame 13 of the rolling mill 10 about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are two free wheeling work rolls 17 and 18 having a diameter substantially smaller than the diameter of the back-up rolls 11 and 12. The work rolls 17 and 18 are journaled for rotation and arranged to idle in the machine frame 13. They are adapted to float in a vertical direction along the plane 15. The specific support mechanisms 19, 20, 21, and 22, etc., for the respective rolls 11, 12, 17 and 18 of the mill 10 may have any desired structure in accordance with conventional practice as amply illustrated in the various patents cited in the aforenoted Background of the Invention.

A motor driven screw down presser means 23 of conventional design is utilized to provide a desired compressive force between the back-up rolls 11 and 12 and their cooperating work rolls 17 and 18 and between the work rolls themselves. The arrangement discussed thus far is in most respects similar to the arrangement of a conventional four high rolling mill.

In accordance with this invention a conventional mill is modified by changing the speed relationship between the lower back-up roll 11 and the upper back-up roll 12 such that the peripheral speed of the lower back-up roll $V_1$ is less than the peripheral speed $V_4$ of the upper back-up roll 12. This can be accomplished relatively easily by a gear set 24 as in FIG. 3 which will drive the upper back-up roll 12 at a higher speed relative to the lower back-up roll 11 in proportion to the desired reduction in thickness of the strip A passing through the mill. The back-up rolls 11 and 12 are driven by a motor 25 which is connected to the rolls 11 and 12 through reduction gear set 24 and drive spindles 26 and 27. The drive to the work rolls 17 and 18 is provided by the back-up rolls 11 and 12 acting through the encompassing strip A.

In a conventional four high rolling mill a single rolling bite would be taken in the strip A as it passed through the nip between the work rolls. This is also the approach used by Vydrin et al. in reference to FIG. 6 of their '017 patent.

In accordance with this invention the strip A is strung or threaded as shown in FIG. 1 whereby the incoming strip is wrapped around the slower moving back-up roll 11 and then forms an "S" shaped bridle around the work rolls 17 and 18 and finally exits by encompassing the fast moving back-up roll 12. In this manner three reductions as shown in FIG. 1 are taken in the strip A as it passes through the mill 10. The first reduction is between the slow moving lower back-up roll 11 and its cooperating lower work roll 17. The second reduction is between the lower and upper work rolls 17 and 18. The third reduction is between the upper work roll 18 and its cooperating fast moving upper back-up roll 12. Front and back tensions $T_1$ and $T_4$ are applied to the strip A in a conventional manner by any desired means such as the bridle roll sets 28 and 29. The strip A is uncoiled and recoiled using conventional coilers 30 and 31.

The strip A encompasses each of the work rolls 17 and 18 through about 180° of the circumference of the rolls. In the embodiment shown the strip A encompasses each of the back-up rolls 11 and 12 to a greater extent, namely about 270°. Since the strip A only encompasses the work rolls through about 180° it is relatively easy to apply coolant and lubricant as shown in FIG. 1. The specific apparatus for applying the coolant and lubricant may be of any desired conventional design as are known in the art. The large size of the back-up rolls 11 and 12 also allows for relatively easy application of coolant and lubricant as shown even with a high degree of wrap.

In operation the strip A is threaded through the mill 10 in the manner shown in FIG. 1 and suitable back and forward tensions $T_1$ and $T_4$ are applied to the leading and trailing portions of the strip A by means of the bridle roll sets 28 and 29. The presser means 23 which may be of any conventional design and which may be hydraulically actuated (not shown) or screw 32 actuated through a suitable motor drive 33 is operated to apply a desired and essential operating pressure or compressive force between the respective rolls 11, 12, 17 and 18. The tension $T_1$ and $T_4$ applied to the strip A preferably should be sufficient to prevent slippage between the rolls 11, 12, 17 and 18 and the strip A. The motor 25 is energized to advance the strip A through the mill 10 by imparting drive to the back-up rolls 11 and 12 which in turn drive the idling work rolls 17 and 18 through the strip A. The upper back-up roll 12 and the work rolls 17 and 18 are arranged for floating movement vertically along the plane 15. In the preferred embodiment the roll axes 14, 16, 34 or 35 of each of the back-up rolls 11 and 12 and work rolls 17 and 18 all lie in the single vertical plane 15 as shown. If desired, however, to attain greater stability for the work rolls 17 and 18, the plane defined by the axes 34 and 35 of the work rolls 17 and 18 can be tilted very slightly with respect to the plane 15 defined by the axes 14 and 16 of the back-up rolls 11 and 12 so that the angle defined between the plane of the work rolls 17 and 18 and the plane 15 of the back-up rolls 11 and 12 is less than about 10° and preferably less than about 5°. The plane of the work rolls 17 and 18 if tilted at all should preferably be tilted in a direction to further deflect the strip A, namely clockwise as viewed in FIG. 1.

However, it is not essential in accordance with this invention that the plane of the work rolls 17 and 18 be tilted with respect to the plane 15 of the back-up rolls 11 and 12 and such an expedient should only be employed in the event that it is necessary to provide stabilization of the work rolls 17 and 18. Alternatively, it is possible though not desirable to stabilize the work rolls 17 and 18 by the use of a stabilizing roller engaging the free surface of the work rolls 17 and 18 which in FIG. 1 is the surface to which the coolant and lubricant is directed. Such an approach would inhibit the application of coolant and lubricant.

In any event if it is desired to tilt the plane of the work rolls 17 and 18 relative to the plane 15 of the back-up rolls 11 and 12, the degree of tilt should be kept within the aforenoted ranges and should not be so great as to prevent the application of pressure by means 23 to the three roll bites.

It is desired in accordance with this invention that the pressure means 23 be adapted to apply the pressure to the respective rolls 11, 12, 17 and 18 rather than generating such pressure between the respective rolls solely by means of the tension applied to the strip as in the Franek et al. apparatus.

When the mill 10 is powered up and put under reasonable separating force by the presser means 23, the three reduction points are attained as shown in FIG. 1. The first reduction point between the lower driven slow back-up roll 11 and the lower free wheeling work roll 17 provides a reduction which is believed to be small but significant. While the mechanism of the first reduction is not fully understood it is believed to be consistent with the mechanism involved in planetary rolling wherein one small roll 17 is used in cooperation with a very large roll 11. The planetary rolling mechanism for reduction can be described by mathematical analysis to be effectively the same as a reduction which would result from an equivalent symmetrical rolling with two identical rolls having an effective radius approaching that of the small roll or work roll 17. Further, since the back-up roll 11 is a driven roll and operates in conjunction with the work roll 17 which is an idler roll the pressure diagram of the resultant pair should be very significantly modified and can be demonstrated mathematically to show a cutting off of the pressure peak and the introduction of two level breaks in the pressure distribution curve. This effect should occur even if both rolls 11 and 17 are moving at the same peripheral speed. However, it is believed that the lower work roll 17 will be operating in the embodiment shown in FIG. 1 at a somewhat higher speed $V_2$ than the lower back-up roll 11.

The third reduction in the cooperative rolling apparatus 10 of this invention should in essence be governed by essentially the same mechanism as the first reduction. It too utilizes a small roll 18 operating in conjunction with a very large roll 12 and, therefore, is believed to be governed by the aforenoted planetary rolling mill mechanism. Similarly, it is believed that the third reduction will achieve a small but significant reduction.

In the four high setup shown in FIG. 1 it is believed that each of the smaller rolls 17 and 18 will be operating near the same peripheral speed as its respective cooperating larger driven roll 11 or 12. For example, the peripheral speed $V_2$ of the lower work roll 17 would be somewhat greater than the speed $V_1$ of the lower back-up roll 11. Similarly, the peripheral speed $V_3$ of the upper work roll 18 would be somewhat less than the peripheral speed $V_4$ of the upper back-up roll 12.

Further, it is believed that the speed $V_2$ of the lower work roll 17 is substantially less than the speed $V_3$ of the upper work roll 18. At the interface identified as the second reduction, which is the interface at the center of the roll set, and between the adjoining work rolls 17 and 18 the work rolls are believed to be operating at respective peripheral speeds approximating the peripheral speed ratio of their cooperating outer driven rolls 11 and 12. It is believed that in this region the highest singular reduction occurs since the roll pressure diagram for two rolls operating at different speeds and rotating in opposite directions yields much lower pressures concomitant with the essentially complete elimination of the pressure peak normally related ti the neutral point in conventional rolling.

In this way, the cooperative rolling process of the present invention utilizing the apparatus 10 described results in three rolling passes being accomplished in one pass of the strip A through the mill 10 by active mechanisms which all tend towards reducing the separating force for rolling.

As shown in FIG. 1 it is believed that the forward and back tensions $T_2$ and $T_3$ in the reduction zones for this process are principally provided by the wrapping of the strip A around the driven back-up rolls 11 and 12 in such a way as to provide shear drag on the strip. Since the workpiece or strip A encompasses the slower large driven roll 11 little or no slipping should occur around the periphery of this roll 11 because of the back tension $T_1$ provided by the bridle roll set 28 and the shear drag of the roll itself. A similar situation exists for the upper backup roll 12 because of the forward tension $T_4$ and the shear drag of this roll. The driven uppermost large back-up roll 12 should be driven at a peripheral speed consistent with the final desired gage of the strip A. Accordingly, it will be rotating at a peripheral speed $V_4$ relative to the speed $V_1$ of the lower back-up roll 11 which is proportional to the total reduction which is to be done in the roll stand 10.

The ratio between the diameters of the back-up rolls 11 and 12 and the diameters of the work rolls 17 and 18 should in accordance with this invention preferably range from about 2:1 to 9:1 and most preferably from about 3:1 to 8:1. This results in a distinct difference in the diameters of the respective work 17 and 18 and back-up rolls 11 and 12. However, the difference in diameters need not be as drastic as required in accordance with the prior art apparatuses. The apparatus as shown in FIG. 1 is adapted to lower the separating forces preferably by a minimum of 2:1 as compared to a conventional four high mill.

The amount of wrap of the strip about the driven backup rolls 11 and 12 depends on the friction and lubricity conditions between the strip A and the respective back-up roll 11 or 12 and may be set as desired to assure minimization of any slippage which might occur between the strip A and the rolls. The total force or pressure between the top and bottom back-up rolls 11 and 12 is positive and less than that required for conventional rolling. Since the gage of the resulting strip A is determined by the relative peripheral speed ratio between the upper and lower back-up rolls 11 and 12 the apparatus 10 is generally insensitive to the pressure applied by the presser means 23 over a resonable range of pressure.

In the apparatus 10 of FIGS. 1–3 the difference in peripheral speed of the respective upper and lower back-up rolls 11 and 12 was provided by modifying the transmission 24 of the drives 24–27 to those respective rolls through the use of suitable reduction gearing 24. For example, if the upper back-up roll 17 is driven through a forty tooth gear 36 and the lower back-up roll 11 is driven through a fifty tooth gear 37 a 20% difference is provided in the relative peripheral speeds of those rolls and the reduction in strip thickness taken through the mill will be 20%. Other reduction ratios can be provided by suitably choosing respective drive gears 36 or 37 for each of the rolls 11 and 12. A variable speed transmission could be used to vary the speed ratio between the rolls 11 and 12 to vary the rolling reduction.

Figure 4:
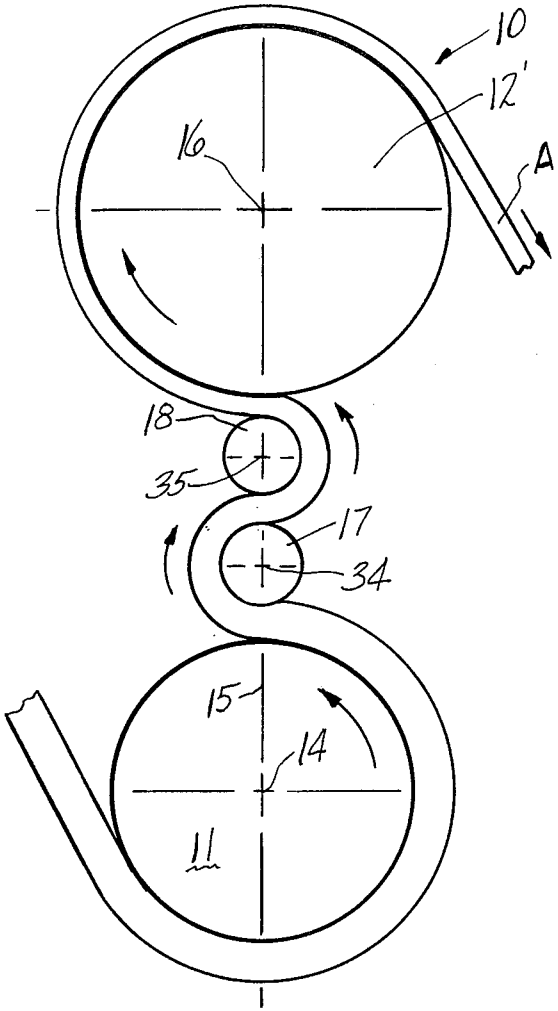
FIG. 4 is a schematic illustration of an apparatus in accordance with a different embodiment of this invention, having back-up rolls of differing diameters.

Alternatively, if desired, however, a conventional drive system of a conventional four high rolling mill can be employed as a single speed drive to rotate the upper and lower back-ups rolls 11 and 12' at the same number of revolutions per minute as shown in FIG. 4. A difference in the peripheral speed $V_1$ and $V_4$ of the rolls 11 and 12' is provided by using an upper roll 12' with a diameter which is related to the diameter of the lower roll 11 to provide a difference in peripheral speed $V_1$ versus $V_4$ as in the previous embodiment and in accordance with the desired reduction ratio. This modification can be achieved with very little modification to a conventional four high rolling mill. It requires only the substitution of a relatively larger back-up roll 12' for the normal upper back-up roll. The apparatus shown in FIG. 4 is essentially a modified version of the apparatus of FIG. 1 and, therefore, the other respective elements of the apparatus will not be described. The difference between the apparatus 10' of FIG. 4 and that of FIG. 1 is the use of a single speed drive mechanism for driving both the upper 12' and lower 11 back-up rolls and the use of a larger diameter upper back-up roll 12.

Figure 5:
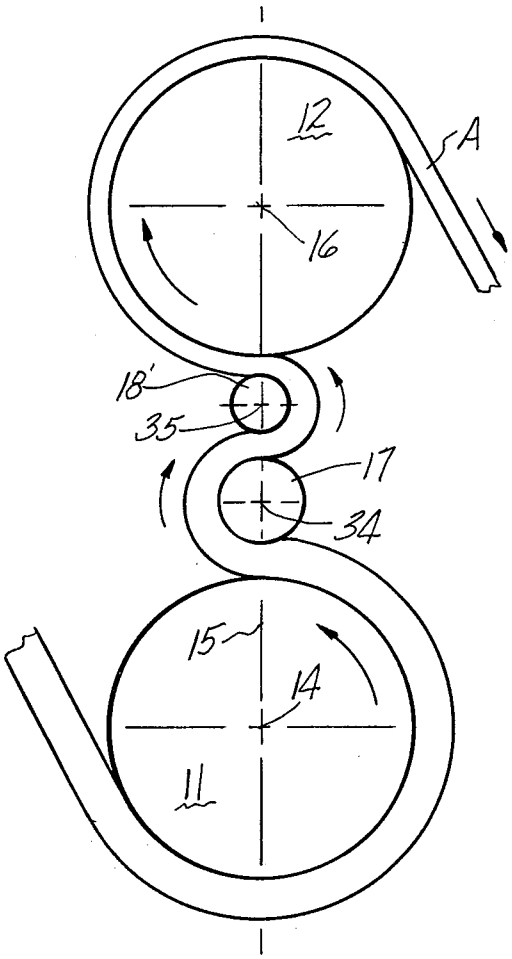
FIG. 5 is a schematic illustration of an apparatus in accordance with yet another embodiment of this invention having work rolls of different diameters.

In the embodiments which have been described thus far the work rolls 17 and 18 have been essentially of the same diameter. In accordance with the embodiment shown in FIGS. 5 and 6 which are merely modified versions of the apparatus of FIG. 1 it is illustrated that it is possible to utilize work rolls 17, 17', 18 or 18' of differing diameters. In FIG. 5 the upper work roll 18' is relatively smaller in diameter than the lower work roll 17; whereas, in FIG. 6 the reverse is true so that the upper work roll 18 is larger than the lower work roll 17'. The use of work rolls 17, 17', 18 or 18' of different diameters can be helpful in controlling the degree of reduction in the respective first and third reduction zones.

Figure 6:
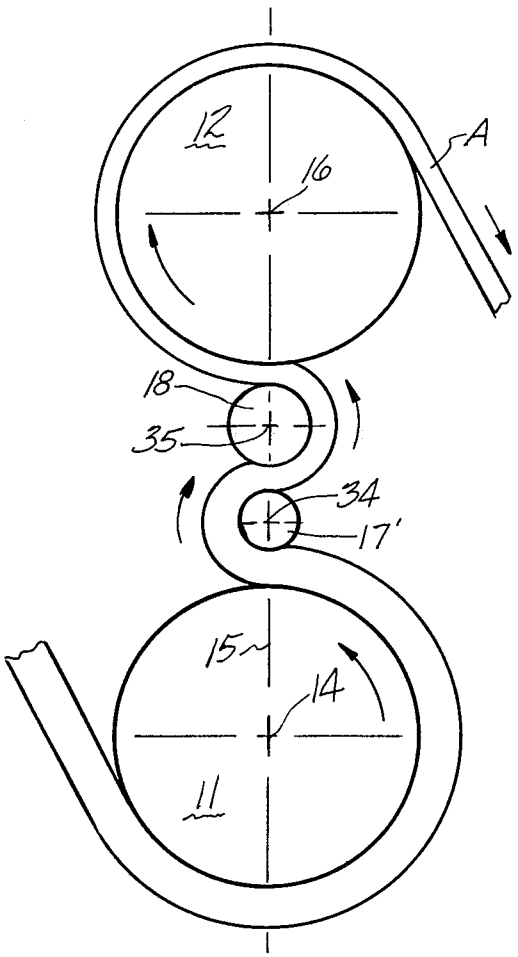
FIG. 6 is a schematic illustration of an apparatus in accordance with this invention, having work rolls of differing diameters in a reversed orientation as compared to FIG. 5.

In the apparatuses of FIGS. 5 and 6 the rolls 11 and 12 are driven by a two speed transmission 24 as described by reference to FIG. 1. However, if desired, the upper back-up roll 12 in the apparatuses of FIGS. 5 and 6 could also be changed in the manner described by reference to FIG. 4 and a single speed transmission utilized.

It is preferred in accordance with this invention to drive both of the back-up rolls in order to insure that the reduction ratio is related to the speed ratio of the respective rolls.

In summary, therefore, in accordance with the present invention a unique cooperative rolling apparatus is provided. The apparatus includes at least two back-up rolls and at least two work rolls arranged with their axes generally in a plane as in FIG. 1. The back-up rolls 11 and 12 are driven and the work rolls 17 and 18 are free wheeling. The strip is threaded through the apparatus in the serpentine arrangement as shown to create three reduction zones. The back-up rolls are driven at different peripheral speeds in accordance with the desired reduction ratio.

In accordance with this invention a conventional four high 6"×6" rolling mill was set up as in FIG. 1 with 1½" diameter work rolls. The back-up rolls were 6" in diameter. The rolling mill was back-up driven through a pinion stand reduction gear transmission connected by appropriate spindles. The peripheral speed reduction from upper back-up roll to the lower back-up roll was accomplished by modifying the transmission by changing the gears in the pinion stand reducer to yield a 20% difference in rotational rpm or peripheral speed between the back-up rolls.

Stainless steel Alloy 304 at 0.020" gage, annealed and in a 2" wide strip was selected as the starting material for rolling using this mill. The Alloy 304 strip was rolled from the 0.020" gage down to 0.0027" in nine passes with a 20% reduction in thickness in each pass. The total reduction comprised about 86%. When the mill was run in a conventional 4-high mode without the modifications in accordance with this invention, it was only possible to get about 58% total reduction for this alloy before requiring an anneal.

Tests were also run using the same 4-high mill in the cooperative rolling arrangement of this invention and employing copper base alloys. CDA Alloy 110 strip which was quarter hard and had a thickness of 0.032" was rolled to 0.0067" in seven passes not including the prior reduction to provide the quarter hard condition. A 20% reduction in thickness was employed in each of the seven passes. Tests were also conducted with a very much stronger and less ductile aluminum bronze. CDA Alloy 688 which was in the half hard condition with an initial strip thickness of 0.029" was rolled in seven passes to 0.0061" with a 20% reduction in thickness in each pass. CDA Alloy 688 is normally annealed after about a 50% total reduction by conventional rolling. With the processing carried out in accordance with this invention as set forth above, it was possible to achieve about a 78% total reduction which does not include the prior reductions to provide the half hard condition.

The results which have been described above are quite surprising and unexpected. A normal pass schedule used commercially generally involves a series of decreasing percentage reductions as the strip work hardens. As demonstrated above when using the cooperative rolling process of this invention as described, there was no need to reduce the percent thickness reduction between passes.

The process and apparatus of this invention is therefore capable of achieving substantial economies and improvements in the efficiency of the rolling operation by increasing the percentage reduction which can be taken in each pass through the mill and by increasing the total number of passes which can be taken between anneals. This is accomplished without the various drawbacks as described by reference to the prior art processes. Further the apparatus and process of the present invention achieves these improvements in a substantially simplified manner as compared to the prior art approaches.

While in the examples a 20% reduction per pass was employed, greater percentage reductions per pass could be employed if desired. It is believed that the process of this invention is capable of achieving at least a 35% reduction per pass. While it is possible in accordance with this invention to carry out the rolling with the same percentage reduction per pass as demonstrated, any desired pass schedule could be employed.

While the invention has been demonstrated in reference to stainless steel and copper base alloys, it is believed to be widely applicable to any metal or alloy susceptible of plastic deformation including, but not limited to, iron and iron alloys, copper and copper alloys, nickel and nickel alloys, and aluminum and aluminum alloys.

While a vertical arrangement of the roll stack has been shown, they can be arranged horizontally or otherwise as desired. It has been found possible in practice to operate the aforenoted 6"×6" mill without the use of bridle roll sets 28 and 29 so that the tensions $T_1$ and $T_4$ are provided by the coilers 30 and 31.

The term "generally in a plane" as used in reference to the arrangement of the various roll axes 14, 16, 34 and 35 is intended to include any slight tilting of the plane of the work roll axes 34 and 35 relative to the plane 15 of the back-up roll axes 14 and 16.

In accordance with the present invention, it is possible to employ a substantial number of passes through the mill without so increasing the separating force so as to render the mill inoperative for further reduction and require an anneal. Further the separating force generated by the process and appratus of this invention is considerably lower than would be expected for a conventional rolling mill. The process and apparatus in accordance with this invention is limited only by the ability of the strip to absorb plastic deformation.

The patents and article set forth in the background of this application are intended to be incorporated by reference herein.

It is apparent that there has been provided in accordance with this invention a cooperative rolling process and apparatus which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

We claim:

1. A rolling mill apparatus adapted to provide increased percentage reductions in the thickness of metal strip per pass and increased total reductions between anneals, said apparatus comprising:

at least first and second driven back-up rolls having respective first and second roll axes defining a first plane, said back-up rolls being arranged for relative movement along said first plane toward and away from each other;

at least first and second idling work rolls having respective third and fourth roll axes, said work rolls having substantially smaller diameters than said back-up rolls, said third and fourth roll axes being arranged generally in said first plane, said work rolls being arranged between said first and second back-up rolls and said work rolls being arranged for relative movement generally in said first plane toward and away from said backup rolls and from each other;

means for driving said back-up rolls so that the peripheral speed of said first back-up roll is less than the peripheral speed of said second back-up roll;

said rolls being arranged to take three thickness reductions in said strip in a single pass through said mill, a first of said reductions being taken in a first roll bite between said first back-up roll and said first work roll, a second of said reductions being taken in a second roll bite between said first work roll and said second work roll and a third of said reductions being taken in a third roll bite between said second work roll and said second back-up roll;

said rolls being arranged so that said strip travels through said mill in a serpentine fashion wherein said strip first encompasses said first back-up roll and then forms an S-shaped bridle about said work rolls and then encompasses said second back-up roll;

means for applying forward and back tension to said strip as it passes through said mill; and presser means for applying a desired pressure between said rolls.

2. An apparatus as in claim 1 wherein a ratio of diameters of said first or second back-up rolls to said first or second work rolls is from about 2:1 to about 9:1.

3. An apparatus as in claim 2 wherein said ratio is from about 3:1 to about 8:1.

4. An apparatus as in claim 1 wherein said third and fourth axes of said work rolls define a second plane and wherein said second plane of said work rolls is tilted relative to said first plane of said back-up rolls in an amount less than about 10 degrees and in a direction into said metal strip.

5. An apparatus as in claim 4 wherein said second plane of said work rolls is tilted relative to said first plane of said back-up rolls less than about 5 degrees.

6. An apparatus as in claim 1 wherein said second back-up roll has a diameter smaller than the diameter of said first back-up roll.

7. An apparatus as in claim 6 wherein said drive means is arranged to drive said first and second back-up rolls at the same number of revolutions per minute and wherein said diameters of said first and second back-up rolls are selected so as to provide said peripheral speed ratio.

8. An apparatus as in claim 1 wherein said first work roll has a diameter different from said second work roll.

9. An apparatus as in claim 8 wherein said first work roll has a larger diameter than the diameter of said second work roll.

10. An apparatus as in claim 8 wherein said first roll has a diameter smaller than the diameter of said second work roll.

11. An apparatus as in claim 1 wherein said plane of said work rolls is arranged generally vertically.

12. An apparatus as in claim 1 wherein said drive means comprises a variable speed drive means adapted to change said ratio of said peripheral speeds of said work rolls.

13. An apparatus as in claim 1 wherein said drive means drives said back-up rolls at respectively different numbers of revolutions per minute.

14. An apparatus as in claim 1 wherein said strip encompasses about 180 degrees of each of said work rolls.

15. An apparatus as in claim 1 wherein said strip encompasses said first and second back-up rolls over a sufficient portion of the circumference thereof to prevent slippage between said strip and said back-up rolls.

16. An apparatus as in claim 15 wherein said strip encompasses about 270 degrees of said circumference of said back-up rolls.

17. An apparatus as in claim 1 further including means for applying coolant and lubricant to each of said rolls at a surface not encompassed by said strip.

18. A process for rolling metal strip adapted to provide increased percentage reduction in the thickness of the metal strip per pass, and increased total reductions between anneals, said process comprising:

providing at least first and second driven back-up rolls having respective first and second roll axes defining a first plane, said back-up rolls being arranged for relative movement along said first plane toward and away from each other;

providing at least first and second idling work rolls having respective third and fourth roll axes, said work rolls having substantially smaller diameters than said back-up rolls, said third and fourth roll axes being arranged generally in said first plane, said work rolls being arranged between said first and second back-up rolls and said work rolls being arranged for relative movement generally in said first plane toward and away from said back-up rolls and from each other;

driving said back-up rolls so that the peripheral speed of said first back-up roll is less than the peripheral speed of said second back-up roll;

passing said strip through said rolls in a serpentine fashion wherein said strip first encompasses said first back-up roll and then forms an S-shaped bridle about said work rolls and then encompasses said second back-up roll;

applying forward and back tension to said strip as it passes through said rolls;

applying a desired pressure between said rolls;

whereby a first reduction in thickness is taken in a first roll bit between said first back-up roll and said first work roll, a second reduction in thickness is taken in a second roll bite between said first work roll and said second work roll and a third reduction in thickness is taken in a third roll bite between said second work roll and said second back-up roll.

19. A process as in claim 18 further including the step of selecting said rolls such that the ratio of diameters of said first or second back-up rolls to said first or second work rolls is from about 2:1 to about 9:1.

20. A process as in claim 19 wherein said ratio is from about 3:1 to about 8:1.

21. A process as in claim 18 wherein said third and fourth axes of said work rolls define a second plane and further including tilting said second plane of said work rolls relative to said first plane of said back-up rolls in an amount less than about 10 degrees and in a direction into said metal strip.

22. A process as in claim 21 wherein said second plane of said work rolls is tilted relative to the first plane of said back-up rolls less than about 5 degrees.

23. A process as in claim 18 wherein said driving step comprises driving said first and second back-up rolls at the same number of revolutions per minute and selecting diameters of said first and second back-up rolls so as to provide said peripheral speed ratio.

24. A process as in claim 18 comprising selecting work rolls such that said first work roll has diameter different from said second work roll.

25. A process as in claim 18 wherein said driving step comprises driving said back-up rolls at respectively different numbers of revolutions per minute.

26. A process as in claim 18 further comprising applying coolant and lubricant to surfaces of said rolls not encompassed by said strip.

27. A process as in claim 18 wherein said strip encompasses about 180 degrees of the circumference of each of said work rolls.

28. A process as in claim 18 wherein said strip encompasses a sufficient portion of the circumferences of said back-up rolls to prevent slipping between said strip and said back-up rolls.

29. A process as in claim 28 wherein said strip encompasses about 270 degrees of the circumferences of said back-up rolls.

30. A process as in claim 18 comprising passing said strip through said rolls in a plurality of passes wherein the percent reduction in thickness for each pass of said strip through said rolls is the same.

31. A process as in claim 30 wherein the percent reduction in thickness for each pass is at least 20%.

* * * * *

UNITED STATES PATENT AND TRADEMARK OFFICE

CERTIFICATE OF CORRECTION

PATENT NO. : 4,244,203

DATED : January 13, 1981

INVENTOR(S) : Michael J. Pryor and Joseph Winter

It is certified that error appears in the above—identified patent and that said Letters Patent is hereby corrected as shown below:

In Column 1, line 27, after the words "balance and" delete "in";

In Column 1, line 34, the word "present" should read ---percent---.

In Column 3, line 25, the word "bits" should read ---bites---;

In Column 3, line 65, after the words "back-up roll" a period (.) should be inserted.

In Column 7, line 55, the word "ti" should read ---to---.

In Column 13, line 8, the word "bit" should read ---bite---.

Signed and Sealed this

Ninth Day of June 1981

[SEAL]

Attest:

RENE D. TEGTMEYER

Attesting Officer

Acting Commissioner of Patents and Trademarks